United States Patent [19]

Willim

[11] 4,251,268

[45] Feb. 17, 1981

[54] METHOD OF TREATING BORON-CONTAINING STEEL

[75] Inventor: Fritz Willim, Birmensdorf, Switzerland

[73] Assignee: Concast AG, Zürich, Switzerland

[21] Appl. No.: 92,344

[22] Filed: Nov. 8, 1979

[30] Foreign Application Priority Data

Nov. 17, 1978 [CH] Switzerland ..... 11811/78

[51] Int. Cl.[3] ..... C21C 7/00

[52] U.S. Cl. ..... 75/58; 75/53

[58] Field of Search ..... 75/53, 58

[56] References Cited

U.S. PATENT DOCUMENTS

| | | | |
|---|---|---|---|
| 2,755,181 | 7/1956 | Spire | 75/133 |
| 2,768,892 | 10/1956 | Shoenberger | 75/124 |
| 3,467,167 | 9/1969 | Mahin | 75/58 |
| 3,575,695 | 4/1971 | Mivashita | 75/58 |
| 4,129,439 | 12/1978 | Nashiwa | 75/58 |

FOREIGN PATENT DOCUMENTS 1063583 3/1967 United Kingdom .

*Primary Examiner*—P. D. Rosenberg
*Attorney, Agent, or Firm*—Werner W. Kleeman

[57] ABSTRACT

A method of treating boron-containing steel for continuous casting, especially for teeming or pouring into small sectional shapes or formats with unregulated nozzles. There is introduced into the molten steel located in the casting ladle, by means of an inert carrier gas, in a powder form calcium or a compound thereof, at least one element forming a stable nitride at the melt temperature of the steel and boron or a boron compound. The thus treated steel is protected from renewed reaction with air along its path between the ladle and the continuous casting mold.

6 Claims, No Drawings

METHOD OF TREATING BORON-CONTAINING STEEL

BACKGROUND OF THE INVENTION

The present invention relates to a new and improved method for the treatment of boron-containing steel for continuous casting, especially for teeming into small sectional shapes or formats with unregulated nozzles, wherein steel which has been pre-deoxidized with manganese, silicon and, if desired, aluminium, has added thereto elements such as calcium and boron by means of a carrier gas.

It is well known that boron increases the hardenability of steel; it is approximately ten to one hundred times more effective for this purpose than other alloying elements. For many fields of application it is advantageous that boron-containing steels are more easily deformable in the unhardened state than steels where there has been obtained, by means of other alloying elements, the same hardness and strength properties. However, if too much boron is added the steel becomes brittle, and therefore, it is necessary to comply with narrow limits, for instance, boron is usually added in amounts of 0.0008 to 0.0030%. Throughout the disclosure reference to percent shall be understood as meaning percent by weight. However, to obtain an optimum effect within such range, depending upon the composition of the steel particularly upon the carbon content, even more narrow ranges must be positively and predeterminably maintained. In order to also obtain the desired effect it is important that such boron be present as a metal in the steel and not be bound as an oxide or nitride. Therefore, it is necessary that the excess oxygen and nitrogen be stably bound by other elements. The quantities of silicon and manganese which are usually contained in steel are not adequate for this purpose.

During ingot pouring the required deoxidation of the steel is obtained by the addition of large quantities of aluminium, and it must be ensured that also an adequate quantity of aluminium remains in the steel even if the oxygen content was particularly high prior to deoxidation. At the same time by the addition of titanium, zirconium or the like there is stably bound the nitrogen which has dissolved in the steel such that it no longer can react with the added boron. Additionally, there are frequently prescribed for such steels according to prevailing standards or specifications a content of metallic aluminium in a range of 0.020 to 0.040%, whereby for instance there is strived for insensitivity against unintentional overheating during the thermal treatment, especially during hardening.

Since during the continuous casting of steel with an aluminium content exceeding 0.007% there is present the danger that, during the casting operation, the nozzles will clog due to the deposition of aluminium oxide, such steels only can be cast with stopper-regulated, over-dimensioned nozzles. In order to bundle the casting jet, which tends to flutter during the throttling which occurs at the tundish stoppers, it is necessary to use immersible pouring tubes. These immersible pouring tubes likewise must be over-dimensioned, in order to thus compensate the deposition of alumina. Therefore, such steels can only be cast during continuous casting in large sectional shapes or formats, for instance into slabs or blooms.

During the continuous casting of small sectional shapes, such as for instance, billets, there however arise difficulties owing to the sensitivity of the infeed regulation, the relatively high casting speeds which are typical for such sectional shapes and, especially, due to the size of the immersible pouring tubes which must be introduced into the continuous casting mold. These difficulties can cause disturbances in the course of the casting operation. Therefore, small sectional shapes are usually cast with so-called free-flowing, unregulated nozzles, where the throughflow quantity, and thus, the withdrawal speed is determined by the internal diameter of the nozzle. During the casting or teeming operation this should not vary, in particular the nozzle should not clog. With the conventional methods it is therefore necessary to limit the aluminium content of the steel, depending upon composition and temperature, to a maximum of 0.004 to 0.007%. With this low content of aluminium it is not possible to obtain the low content of soluble oxygen which is necessary if the boron is to be added as an alloy in the ladle, and thus, there is to be ensured the requisite narrow range of metallic boron which is dissolved in the steel.

It is known from the continuous casting art, during the continuous casting of boron-containing steels into billets, to infeed the boron in the form of wire into the continuous casting mold, for instance by means of the casting jet of the tundish. However, this is associated with the drawback that the addition is extensively ineffectual and to a degree which cannot be clearly predicted ahead of time, because the boron reacts with the oxygen and nitrogen which has not yet dissolved in the steel, and therefore, becomes ineffectual in terms of improving the hardenability of steel. If, however, the added quantities of boron are increased, in order to compensate for such additional oxidizing loss, then the danger exists that there will be undesirably obtained too high a boron content. With the known addition of boron in wire form there furthermore is present the difficulty that, in order to incorporate a sufficient quantity of boron into the melt, the wire thickness and/or the wire infeed speed must be maintained quite high. However, the need for large wire thickness is associated with the difficulty of handling the wire due to the increased wire stiffness, and the increased infeed speed results in difficult to control inaccuracies in the boron content.

Equally, it is known from practise to deoxidize a steel by blowing-in pulverulent calcium in the form of CaSi or $CaC_2$ or the like, by means of an inert carrier gas, such as typically nitrogen or argon. More recent investigations have shown that it is possible to cast such treated steel even then with a freeflowing nozzle if it simultaneously also contains increased quantities of metallic aluminium, for instance 0.040%. With this known method which has heretofore preferably been used for ingot casting the largest quantity of the oxygen which has been dissolved in the steel is normally initially bound by the addition of aluminium, and only thereafter the smaller quantity of such oxygen by blowing-in calcium. On the one hand, aluminium is less expensive than calcium, and, on the other hand, it has been recognized that inclusions consisting of calcium aluminate can be more easily removed from the steel than aluminium-free calcium-oxide inclusions.

Furthermore, there is known to the art a method for the continuous casting wherein there are added to a casting ladle and/or a tundish, by means of a transport gas, for instance, oxidation, reduction or neutral gas, different elements for the deoxidation, alloying, cooling and so forth in the form of additives in powder form. In this way there should be possible a uniform distribution of the additives in the melt for the purpose of obtaining a homogeneous cast section. With this prior art method there is not however dealt with the problem of treating boron-containing steels, which particularly should be suitable for casting into small formats or sectional shapes.

SUMMARY OF THE INVENTION

Therefore, with the foregoing in mind it is primary object of the present invention to provide a new and improved method for the treatment of boron-containing steels in a manner not afflicted with the aforementioned drawbacks and shortcomings of the prior art proposals.

Another and more specific object of the present invention aims at the provision of a new and improved method for the treatment of boron-containing steels for continuous casting, which enables incorporating the boron into the melt in exactly dosed quantities without impairment of the castability of the melt and while positively ensuring for a predetermined yield in boron.

Another and noteworthy object of the invention aims at a method of treating boron-containing steel in a manner such that it is possible to cast such steel in a simple manner in small sectional shapes or formats.

DETAILED DESCRIPTION OF THE PREFERRED EMBODIMENTS

Describing now the invention in greater detail, and in order to achieve the aforementioned objectives and others which will become more readily apparent from the disclosure to follow, the invention contemplates adding by means of an inert carrier gas and in powder form, into the steel melt in the ladle, prior to teeming into the continuous casting mold, the calcium or a compound thereof, at least one element forming a stable nitride at the steel melting temperature and boron or a boron compound. The teeming or casting jet emanating from the ladle and flowing into the tundish and between the tundish and the continuous casting mold is protected against contact with the surrounding atmosphere or air.

The steel is pre-deoxidized in known manner with deoxidizing agents, such as manganese, silicon and aluminium. The melt should have a content of metallic aluminium in the order of about 0.010 to 0.020%. Thereafter, there is blown into the ladle in powder form for further deoxidation calcium in the form of CaSi or $CaC_2$, and thus, the oxygen dissolved in the steel is lowered to such a degree that there is essentially hindered oxidation of the subsequently added boron. By means of the calcium there is also caused a reduction of the sulfur content and a favorable influencing of the sulfide.

Thereafter there is blown into the steel melt within the ladle, likewise by means of a carrier gas, preferably argon, at least one element which forms a stable nitride at the steel melt temperature. In this way there is prevented the formation of undesired boron nitrides, since the nitrogen is thus effectively bound as nitride. After the oxygen and the nitrogen have been bound there is infed, likewise by means of a suitable carrier gas, boron or a boron compound, such as for instance borax, ferroboron, nickel boron or ferrosilicon boron in exactly dosed quantities and likewise in powder form.

Due to blowing in of the element forming the nitride and the boron or boron compound in powder form into the steel melt located in the ladle, there is ensured for uniform distribution of these elements.

In order to simultaneously protect the boron during casting against reaction with oxygen and nitrogen the casting or teeming jets emanating from the ladle and reaching the tundish and flowing from the tundish into the continuous casting mold are protected from contact with the surrounding atmosphere or air. This protection against direct contact with the air can be advantageously accomplished, for instance, by using conventional ceramic protective tubes or by employing a protective gas in a liquid or gaseous state. In this way there is prevented oxidizing loss of the metallic dissolved boron.

The steel which has been treated in the described sequence now contains the required small quantities of effective, i.e. metallic or oxygen soluble boron in the extremely narrow range. There is thus realized a predeterminable yield of boron within narrow limits. Above all, however, the thus treated steel is suitable for the continuous casting of small sectional shapes or formats, such as for instance billets, i.e. it can be teemed or poured into the continuous casting mold by means of free-flowing, non-stopper regulated and non-overdimensioned nozzles, for instance a tundish. This is also then possible if there are required increased aluminium content, for instance 0.020 to 0.040% of metallic aluminium.

There is advantageously used as the element forforming the nitride zirconium and/or titanium or alloys thereof in powder form. Their high affinity ensures for an effective bonding of the nitrogen as a nitride. Calcium and zirconium or titanium can also be simultaneously added, for instance as a calcium-silicon-zirconium alloy and/or a calcium-silicon-titanium alloy.

It can however also be appropriate to blow into the melt a mixture or an alloy formed of the element forming the nitride and boron or a boron compound.

An economical technique for introducing the requisite elements into the melt and to ensure for good distribution is advantageously possible in that, the addition of the calcium, the element forming the nitride and the boron or the boron compound is accomplished by means of a lance or blowpipe having an axial infeed tube. Advantageously, the addition of the elements or additives also can be undertaken by means of a slide mounted at the ladle, whereby there is obtained a particularly effective admixing.

While there are shown and described present preferred embodiments of the invention, it is to be distinctly understood that the invention is not limited thereto, but may be otherwise variously embodied and practised within the scope of the following claims. Accordingly,

What is claimed is:

1. A method of treating boron-containing steel for continuous casting small sectional shapes with unregulated nozzle, comprising the steps of:

pre-deoxidizing steel with at least one element selected from the group consisting essentially of manganese, silicon and aluminium;

adding to the steel melt by means of a carrier gas an element selected from the group consisting of calcium and boron or compounds of calcium and boron;

said last-mentioned step embodying adding to the steel melt in the ladle prior to casting into a continuous casting mold in powder form and by means of the inert carrier gas calcium or a compound thereof, at least one element forming a stable nitride at the steel melt temperature, and boron or a boron compound; and protecting the casting jet moving between the ladle and the tundish and the tundish and the continuous casting mold from contact with the surrounding air.

2. The method as defined in claim 1, further including the steps of:

using as the element forming the nitride a member selected from the group consisting essentially of zirconium, titanium or alloys thereof.

3. The method as defined in claim 1, further including the steps of:

introducing into the steel melt a mixture or an alloy formed of the element forming the nitride and boron or a boron compound.

4. The method as defined in claim 1, further including the steps of:

introducing the element forming the nitride and the boron or boron compound by means of a lance.

5. The method as defined in claim 1, further including the steps of:

introducing the additives by means of a slide arrangement.

6. The method as defined in claim 1, further including the steps of:

casting as the small sectional shapes billets; and controlling the addition of aluminium into the steel melt such that the steel melt has a metallic aluminium content in the order of about 0.010 to 0.020 percent by weight.

* * * * *